US005474299A

United States Patent [19]

Romano

[11] Patent Number: 5,474,299

[45] Date of Patent: Dec. 12, 1995

[54] GOLF SWING TRAINER

[76] Inventor: Edward A. Romano, 3261 17 Mile Dr., Pebble Beach, Calif. 93953-1792

[21] Appl. No.: 101,607

[22] Filed: Aug. 3, 1993

[51] Int. Cl.[6] ..... A63B 69/36

[52] U.S. Cl. ..... 273/187.2; 273/187.6; 273/191 R; 273/191 B; 273/192

[58] Field of Search ..... 273/188 R, 189 R, 273/191 R, 191 B, 192, 187.2

[56] References Cited

U.S. PATENT DOCUMENTS

| | | | |
|---|---|---|---|
| 1,983,920 | 12/1934 | Perin | 273/191 R |
| 2,328,408 | 8/1943 | Beil et al. | 273/191 R |
| 2,472,065 | 6/1949 | Cottingham | 273/191 R |
| 2,737,432 | 3/1956 | Jenks | 346/44 |
| 3,079,152 | 2/1963 | Cushing | 273/187.2 X |
| 3,215,438 | 11/1965 | Sheldon et al. | 273/188 R |
| 3,319,963 | 5/1967 | Cockburn | 273/186 |
| 3,415,523 | 12/1968 | Boldt | 273/186 |
| 3,429,571 | 2/1969 | Abel, Jr. et al. | 273/26 |
| 3,437,339 | 4/1969 | Starck | 273/187.2 |
| 3,595,583 | 7/1971 | Oppenheimer | 273/191 R |
| 3,604,712 | 9/1971 | Prior et al. | 273/186 R |
| 3,876,212 | 4/1975 | Oppenheimer | 273/186 R |
| 3,951,414 | 4/1976 | Nunez | 273/187.2 |
| 4,034,991 | 7/1977 | Oppenheimer | 273/186 A |
| 4,211,418 | 7/1980 | Oppenheimer | 273/186 R |
| 4,268,035 | 5/1981 | Oppenheimer | 273/186 A |
| 4,449,708 | 5/1984 | Humphrey | 273/186 A |
| 5,072,942 | 12/1991 | Hurley | 273/191 A |
| 5,102,142 | 4/1992 | Bittl | 273/187.2 |
| 5,139,264 | 8/1992 | Wootten | 273/191 R |
| 5,156,402 | 10/1992 | Hart | 273/26 R |
| 5,265,876 | 11/1993 | Moon | 273/191 R X |

*Primary Examiner*—William H. Grieb
*Attorney, Agent, or Firm*—Townsend & Townsend

[57] ABSTRACT

The invention provides a golf swing trainer for use by a developing golfer. The trainer includes a rotor that rotates about a rotational axis. When using the trainer, the golfer connects himself or the golf club shaft to the rotor at a point near his hands. The golfer then takes practice swings while linked to the rotor. According to one aspect of the invention, the rotor is flexible so that deviations in the golfer's swing from the ideal path causes flexure of the rotor. This in turn causes noticeable flexure and vibration in the rotor, which clearly indicates the error to the golfer so that he may correct his motion on subsequent swings. According to another aspect of the invention, the rotational inertia of the rotor about the axis is less, and in preferred embodiments much less, than that of the swung club about the same axis. This ensures that the inertia of the rotor will not obscure the natural feel of the proper swing. Rapid development of the golfer's skill is improved with use of the trainer.

24 Claims, 14 Drawing Sheets

183

GOLF SWING TRAINER

BACKGROUND Of THE INVENTION

Golf is a difficult and challenging sport. Much repetition and practice is required to master the proper club swings used when playing. Much of the difficulty arises because the desired golf swings are complicated motions involving simultaneous motion of many parts of the golfer's body. However, this complicated motion can be broken into simpler component elements. If the developing golfer were able to isolate and work to improve these individual component motions, mastery of the required technique could be considerably enhanced.

The invention provides an improved system comprising five elements for assisting a golfer in developing a proper golf swing. More particularly, the invention provides elements, used individually or in combination, which signal the golfer when individual component motions of his swing deviate from those of an ideal swing.

Studies of the swings of practiced golfers have indicated that in an ideal swing the golfer's hands travel in an approximately circular path centered about a point near the top of the golfer's sternum, i.e., near the center of the golfer's collarbone. Mechanical systems have been designed in an attempt to teach this ideal swing to developing golfers. Such systems have commonly included a golf club or club handle rigidly attached to a mechanism that confines motion of the club to the desired path. Systems of this type are disclosed in U.S. Pat. Nos. 2,737,432, 3,415,523, and 3,319,963.

It was thought that by repeatedly swinging the club handle through the prescribed path, the golfer would eventually train his muscles to follow the desired path. Unfortunately, these machines were generally unsuccessful. Most golfers found themselves unable to achieve the desired motion when not attached to the machine.

Devices of this type suffer from at least two deficiencies. First, the club or practice club is rigidly attached to the mechanism, which is itself rigid. This is a consequence of the theory behind such devices, that a golfer can pattern his swing by following a rigidly constrained ideal swing. Unfortunately, in most cases the rigid constraint of the mechanism acts as a "crutch," and the golfer is unable to repeat the desired swing when freed of the practice mechanism.

Secondly, the swing mechanisms are invariably rather heavy. The mass and rotational inertia of the mechanism alone about the swing center are typically at least as much as those of an unrestrained club. The inertial resistance of the mechanism completely obscures the response of the club so that the golfer has no opportunity to develop his own sense of what a proper swing feels like.

It would be desirable, therefore, to provide a golf swing training system that would assist a golfer in developing the desired swing. A desirable swing training system will indicate deviations from the proper swing path without rigidly constraining the club so that the golfer can repeat the desired swing when freed from the device. It would be further desirable if a golf swing trainer could be developed in which the rotational inertia of the rotating parts is substantially less than that of a swung club, so that the inertial resistance of the device does not obscure the golfer's feel of the club.

SUMMARY OF THE INVENTION

The invention provides a golf swing trainer for use by a developing golfer. The trainer includes a rotor that rotates about a rotational axis. When using the trainer, the golfer connects himself or the golf club shaft to the rotor at a point near his hands. The golfer then takes practice swings while linked to the rotor.

According to one aspect of the invention, the rotor is flexible so that deviations in the golfer's swing from the ideal path causes flexure of the rotor. This in turn causes noticeable flexure and vibration in the rotor, which clearly indicates the error to the golfer so that he may correct his motion on subsequent swings. According to another aspect of the invention, the rotational inertia of the rotor about the axis is less, and in preferred embodiments much less, than that of the swung club about the same axis. This ensures that the inertia of the rotor will not obscure the natural feel of the proper swing. Unlike prior devices, the swing trainer of the present invention does not constrain the golfer's swing to a predetermined path. Instead, the golfer is allowed to develop his own swing, with the swing trainer providing an immediate indication when the golfer's swing deviates from the proper path.

In preferred embodiments, the rotor is supported on a pedestal that includes a plurality of legs individually adjustable so that the rotor may be supported on sloping or uneven ground. Additionally, preferred embodiments will generally allow for the convenient adjustment of the slope of the rotor's axis with respect to the ground to accommodate practice with a variety of different clubs. Adjustment of the axis slope may be facilitated by a simple inclinometer mounted on the rotor support.

DESCRIPTION OF SPECIFIC EMBODIMENTS

INTRODUCTION

The present invention provides a system by which a developing golfer can rapidly learn the correct motions that make up a proper golf swing. The complete system comprises five individual subelements. The individual elements may be used separately or in various combinations to provide a complete program for developing a golfer's swing with the full range of clubs. The five individual elements are: 1) a rotary hand swing plane guide; 2) a hip turn guide; 3) a take away guide; 4) a plumb bob guide; and 5) a wrist guide. Each of these five elements is described more fully below.

THE SYSTEM

A. The Hand Swing Plane Guide

The primary object of the hand swing plane guide is to indicate to the golfer the proper path for his hands during the swing, i.e., in an approximately circular path centered about a point located roughly at the center of the golfer's collarbone. The rotating portion of the mechanism is very light, with a rotational inertia generally substantially less than that of the swung club. This ensures that the inertia of the mechanism will not obscure the natural feel of the proper swing. Moreover, portions of the mechanism are made somewhat flexible, so that deviations of the swing from the desired path are indicated by flexure and vibration of the mechanism.

Previous swing trainers have sought to develop the proper swing by constraining the swing to follow the desired path. In contrast, the hand swing plane guide of the current invention operates by indicating deviations from the ideal swing. This new approach is far superior in that it allows the golfer to develop a swing that will be repeatable when the golfer is not assisted by the mechanism. In addition, the low weight and inertia of the mechanism do not obscure the golfer's feel of the swing as was the case with previous constraint-type devices.

Figure 1:
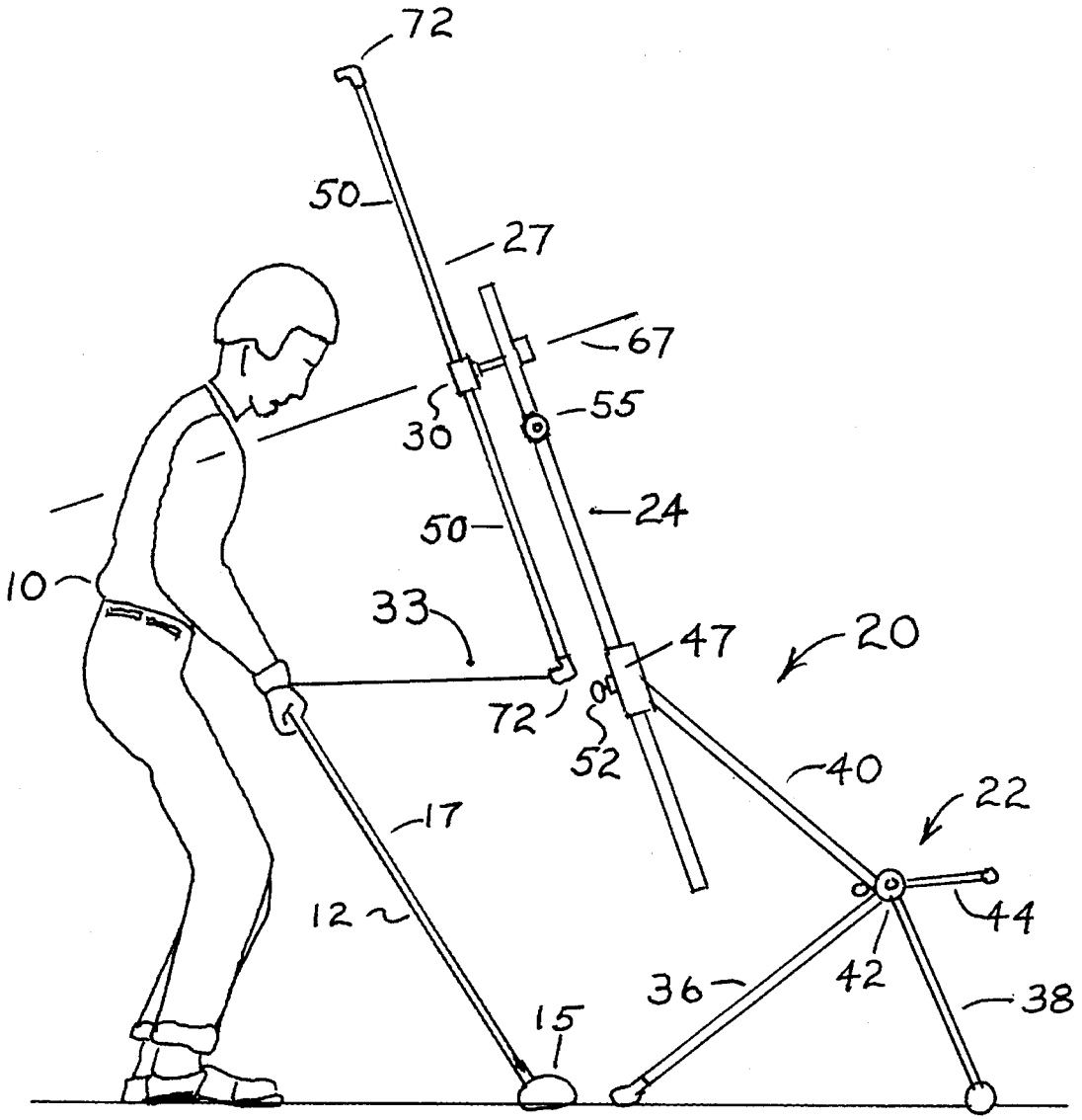
FIG. 1 depicts a hand swing plane guide according to the present invention.

A hand swing plane guide according to the present invention is depicted in use by a golfer in FIG. 1. As depicted therein, a golfer 10 holds a golf club 12 comprising a club head 15 and a club shaft 17. A hand swing plane guide 20 comprises a pedestal 22, which supports a mast 24, which in turn supports a rotor 27.

Rotor 27 is rotatably secured to an axle 30 through mast 24. The golfer is joined to the rotor by a cord 33 looped around the golfer's wrists at one end and around the end of rotor 27 at the other. Alternatively, cord 33 could be secured to the golfer's hands or to club shaft 17 at a point near the golfer's hands. The cord should be just barely taut, with some positive but small tension, e.g., a few ounces, in the cord.

As the golfer begins his swing, the light tension in the cord draws the rotor upward in a circular path with the golfer's hands. As the swing continues, the rotor continues in a circular path to the top of the swing. During the swing, deviations from the ideal circular path will either cause the cord to go slack, in which case the rotor will flex back away from the golfer, or tension in the cord will increase, which will cause the rotor to flex toward the golfer. In either case, vibration and rocking will result in the rotor. These motions will provide the golfer with a clear and immediate indication that his swing has deviated from the ideal.

The golfer will repeat his practice swings at low speed until he is able to track the correct path with his hands. Once he has achieved this, the golfer may build speed until he is practicing smooth, controlled swings along the ideal path at full speed. After much repetition, the golfer will be able to duplicate the desired motion at will with or without the assistance of the practice device.

Figure 2:
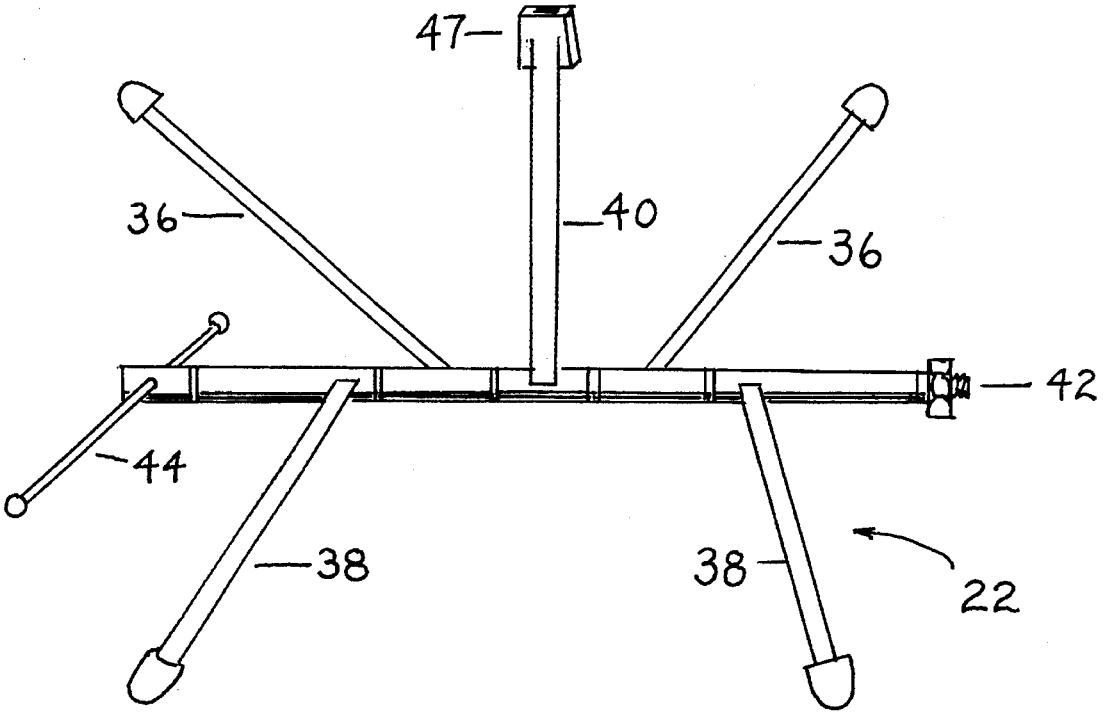
FIG. 2 provides a view of the pedestal that supports the hand swing plane guide of FIG. 1.

The hand swing plane indicator includes several unique features to enhance the usefulness and adjustability of the mechanism. The pedestal that supports the mechanism is depicted in FIG. 2. As depicted therein, pedestal 22 comprises a pair of long legs 36, a pair of short legs 38, and a mast support 40 rotatable about a pedestal bolt 42. Legs 36 and 38 and mast support 40 are held in position by tightening a handle 44 at one end of pedestal bolt 42. To set up the mechanism, the user grasps mast support 40 with pedestal bolt 42 sufficiently loose to allow the legs to move. The user then positions the legs on the ground and tightens the pedestal bolt enough to hold the legs in position. Because each of the four legs is individually adjustable, the pedestal can provide a solid and stable support for the mast at any desired angle regardless of the surface on which the mechanism is placed.

After setting up the pedestal, the user slides mast 24 (see FIG. 1) into mast channel 47 on mast support 40. The user adjusts the mast so that the bottom of rotor arm 50 is at approximately the same height as the golfer's wrist when he is in position to address the ball. When the mast height is approximately correct, the user tightens clamp screw 52 to secure mast 24 in mast channel 47.

After securing the mast in the mast channel, the user rotates mast support 40 with respect to pedestal 22 so that mast 24 is held at the proper angle. The proper mast angle varies depending on the type of club used. For practice with putters, the mast should be set vertical. For a pitch wedge, the top of the mast will be inclined toward the user at an angle of approximately ten degrees. For drivers, an angle of about twenty-five degrees is appropriate. Other clubs will require various angles between zero and twenty-five degrees.

Figure 3:
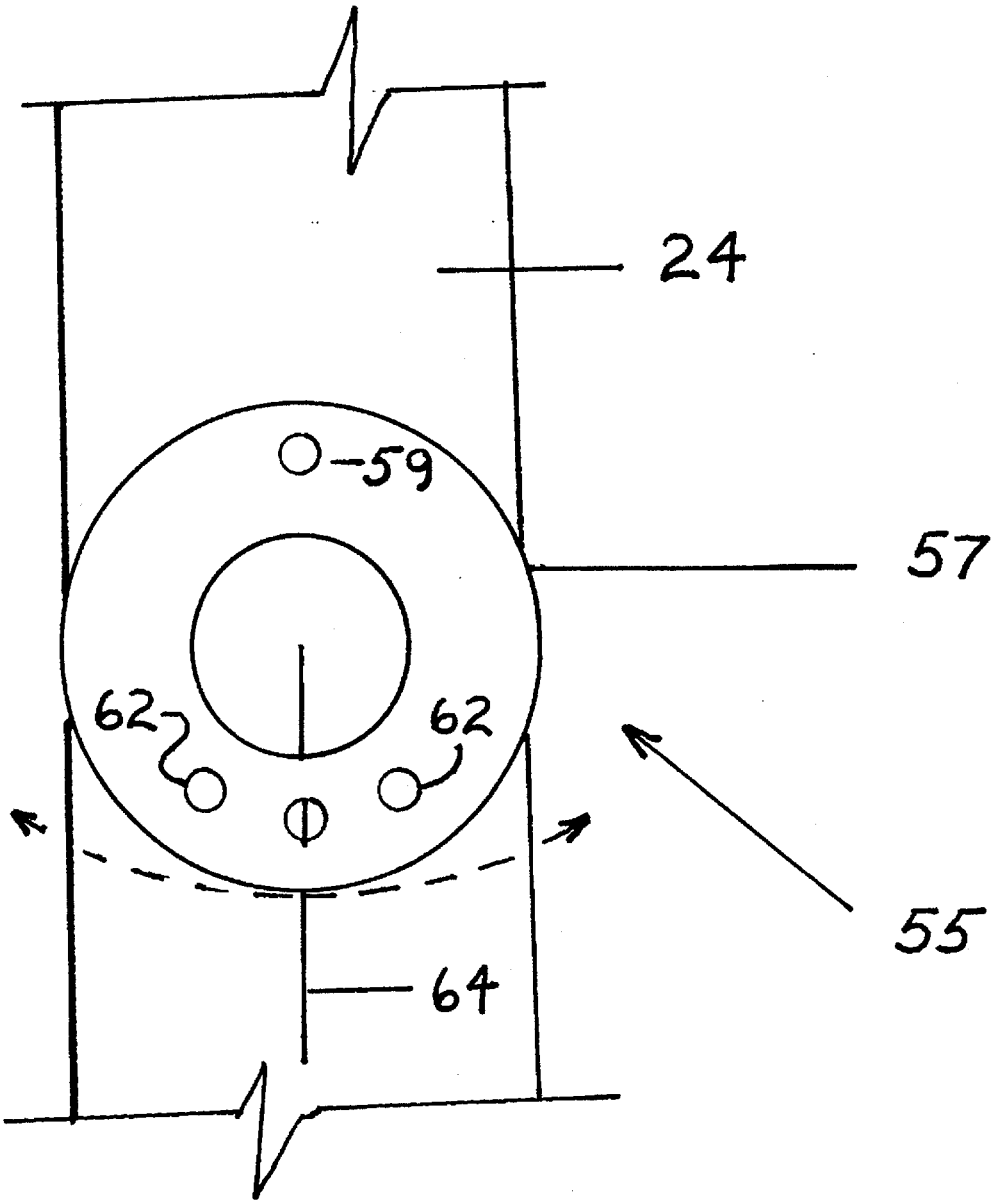
FIG. 3 shows the inclinometer included on the hand swing plane guide depicted in FIG. 1.

Adjustment of the mast support to hold the mast at the desired angle is facilitated by an inclinometer 55 on mast 24 as shown in FIG. 1. As depicted in FIG. 3, inclinometer 55 is in the form of a washer 57, which hangs from a pivot 59. Washer 57 has a series of holes 62 on the side opposite pivot 59. Mast 24 is provided with a mark 64, which can be seen through the holes 62 in the hanging washer. The angle of the mast can be adjusted to the desired value by aligning mark 64 with a selected one of the holes. As mentioned above, various mast angles between about zero and twenty-five degrees will be suitable for different club types. Desirably, the holes will be drilled to indicate angles of zero (vertical), ten, and twenty-five degrees to correspond to the proper settings for putters, pitch wedges, and drivers, respectively. Intermediate settings can be achieved by gauging between the appropriate holes. After the mast is set to the desired angle, the user tightens pedestal bolt 42 to fully secure the mast.

Referring again to FIG. 1, once the pedestal, mast, and rotor have been set up, the golfer slips one end of cord 33 over the bottom end of rotor arm 50. Cord 33 can be conveniently tightened around rotor arm 50 by means of a slip knot tied in the cord. The other end of cord 33 is looped around the golfer's wrists or around shaft 17 of the club at a point near the golfer's hands. In this position the cord should be approximately horizontal. If necessary, the height of mast 24 in mast support 40 may be adjusted once again to achieve the desired alignment of the cord. The golfer may then begin practicing his swing as described above. The extended length of the cord may vary, usually being between about 12 and 48 inches.

Flexibility and low rotational inertia of the rotor are significant features of the hand plane swing guide of the present invention. As depicted in FIG. 1, the golf club and rotor will each rotate about a common axis 67, which passes roughly through the center of the golfer's collarbone. In order that the inertia of the mechanism not obscure the feel of the swung club, the rotational inertia of the rotor about this axis should be substantially less than that of the club shaft and head about the same axis. The rotational inertia of the rotor should be less than that of the club about the same axis, preferably less than one-third of that of the club, and more preferably less than fifteen percent of that of the club.

Rough estimates of the respective rotational inertias of the rotor and the club about the common rotational axis are set forth below. These rough estimates are given primarily to illustrate the principles of the invention; the full scope of the invention should be determined by reference to the appended claims.

The club head of a typical golf club might have a mass of about 260 g (0.260 kg). This mass can be modelled as a point mass rotating about the common axis. The distance between this assumed point mass and the common axis will in practice be about 1.5 m. The rotational inertia of a point mass about an axis can be computed as the mass multiplied by the square of the distance between the mass and the rotational axis ($I=M*r^2$). This gives a rotational inertia for the club head of about 0.585 kg-m$^2$.

The rotational inertia of the shaft should be included as well. A typical golf club shaft might weigh about 4 ounces (about 0.11 kg). The rotational inertia of a thin rod of length l about its center of gravity is given by the formula $I=(M * l^2)/12$. For a 0.11 kg shaft 1 m in length, the rotational inertia of the shaft about its center of gravity is approximately 0.01 kg-m$^2$. This is the rotational inertia about the center of the shaft however. To obtain the rotational inertia about the common axis, a term must be added equal to the mass of the shaft times the square of the distance between its center of gravity and the rotational axis. This term is 0.11 kg times approximately 1 meter squared (the approximate distance between the center of the shaft and the common rotational axis), or about 0.11 kg-m$^2$. The total rotational inertia of the club about the swing axis is therefore about 0.585+0.01+0.11 kg-m$^2$, or about 0.70 kg-m$^2$.

The rotational inertia of the rotor is typically much less. In the prototype device, the rotor is a thin shaft about 1 meter in length having a mass of about 45 g (0.045 kg). Because the rotor rotates about its own center of mass, its rotational inertia can be estimated using the formula $I=(M * 1^2)/12$, where M=0.045 kg and l=1 m. This gives a rotational inertia for the rotor of about 0.045 kg-m$^2$, slightly more than an order of magnitude less than that of the typical golf club assumed above.

Flexibility of the rotor arms is another significant feature of the hand plane swing guide of the present invention. The optimal degree of flexibility is difficult to state with mathematical precision. On one hand, some degree of rigidity is necessary so that the rotor will hold its shape and track the desired path about the rotational axis. On the other hand, sufficient flexibility is required so that deviations in the golfer's swing will be indicated by flexure of the rotor. Optimal rotors will strike a balance between these two considerations.

In prototypical embodiments, the rotor arms have been made variously of wooden doweling, fiberglass rods, and thin tubular aluminum rods. As an example, tubular rods of the type most commonly used as arrow shafts (available from the Easton corporation) have been used in some prototypes. In other embodiments, filament wound epoxy shafts approximately fives-sixteenths of an inch in diameter (available from Glasforms) have been used. In either case, each of the two rotor arms has been about 19.5 inches in length.

The rotor arms should include a sufficient degree of flexibility so that a significant deviation by the golfer from the ideal swing path gives rise to noticeable flexure and vibration in the rotor. This is in contrast to the prior art devices of the type described in U.S. Pat. Nos. 2,737,432, 3,415,523, and 3,319,963. Those devices were intended to constrain the club to a specified path. In contrast, the device of the present invention is designed to indicate deviations from the ideal swing while still allowing the golfer to develop a technique that he will be able to duplicate when not aided by the mechanism.

Figure 4:
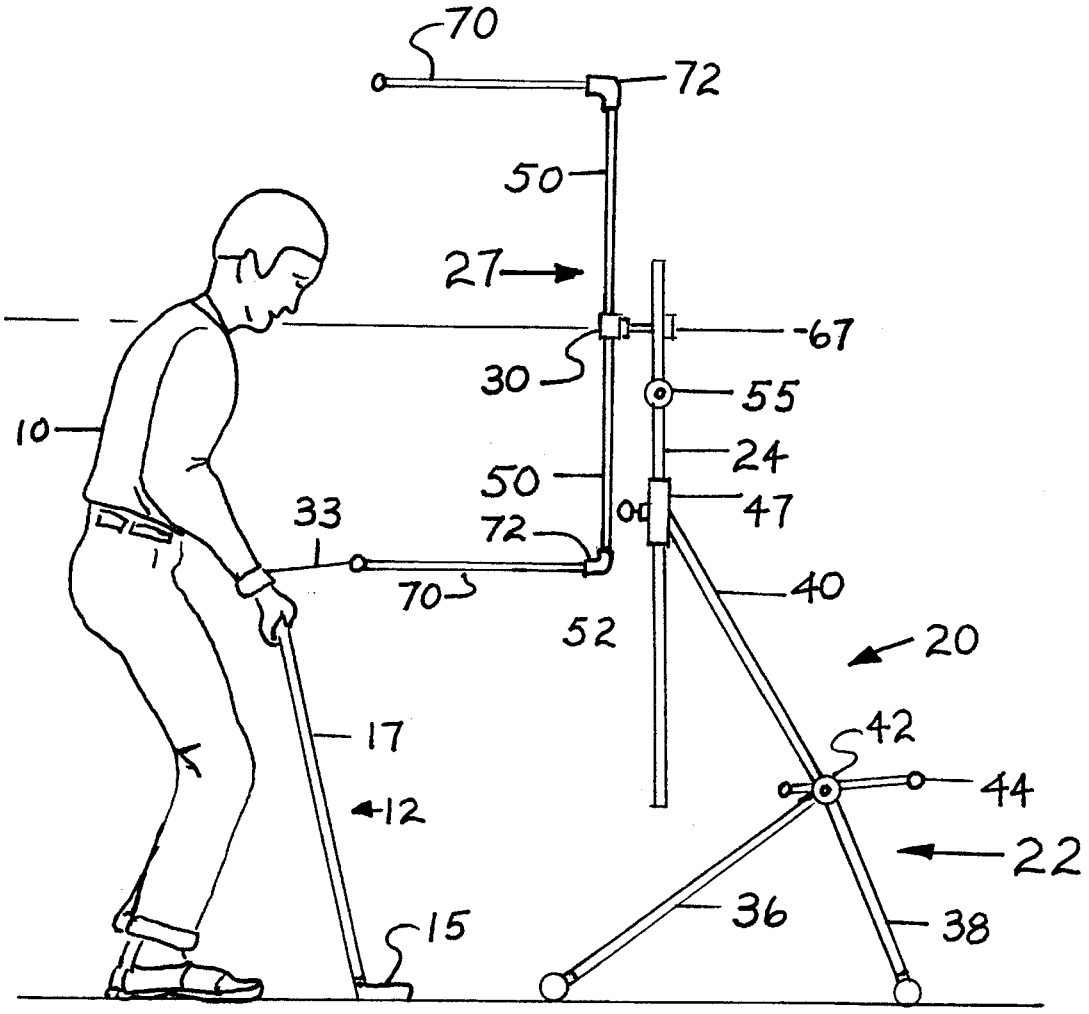
FIG. 4 depicts the hand swing plane guide in use with a pair of extension arms.

For low speed practice swings, and in particular for putting practice, it may be desirable to attach extension arms 70 as depicted in FIG. 4 to the ends of rotor arms 50. The addition of extension arms 70 provides more clearance between the golfer and the mechanism and allows cord 33 to be shorter. In some cases, cord 33 may be eliminated altogether with the golfer slipping his thumb into a loop on the end of the bottom extension arm. The extension arms are typically made from a material similar to that of the rotor arms.

Figure 5:
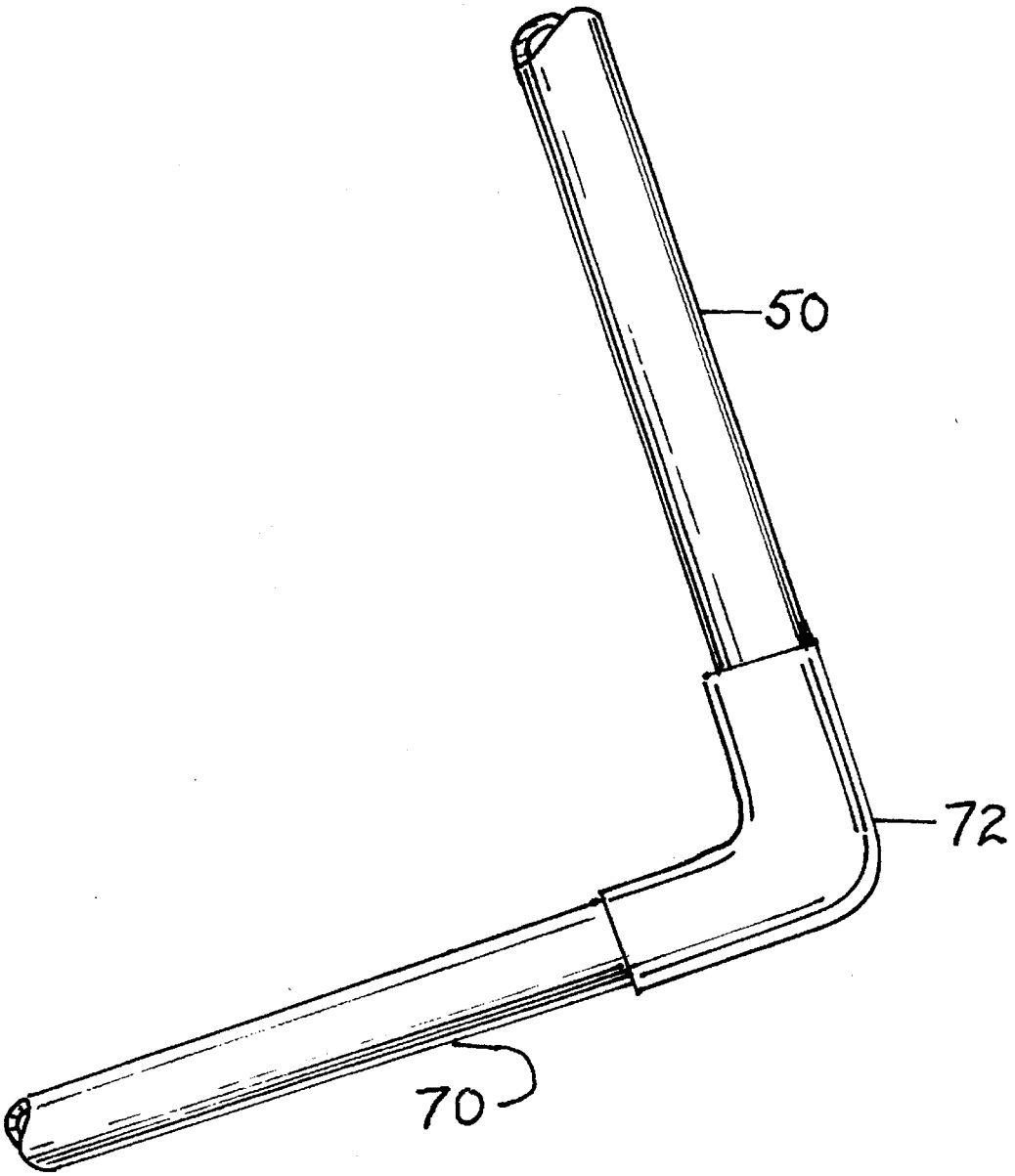
FIG. 5 is a detailed view of the junction between the rotor arms and extension arms of the hand swing plane guide of FIG. 4.

Extension arms 70 slip into plastic elbows 72 at the end of rotor arms 50 where they are held by a friction fit as depicted in FIG. 5. The extension arms should be used only for low speed swing practice. The extension arms add a degree of flexibility to the rotor. This increased flexibility enhances error indication with low speed swings. The extension arms also add rotational inertia to the rotor. At low speeds this will not be noticed by the golfer. If the extension arms were used at high speeds, however, the increased rotational inertia would be more noticeable.

The embodiments depicted herein have a pair of balanced rotor arms rotating about the rotational axis. Alternatively, it may be desirable to use only a single rotor arm and dispense with the upper arm altogether. Single arm rotors are unbalanced. However, the rotational inertia of a single arm rotor is roughly half that of the two arm rotors pictured. This further decrease in the (already small) rotational inertia of the rotor may outweigh the disadvantage of the rotor being unbalanced.

B. The Hip Turn Guide

Figure 6:
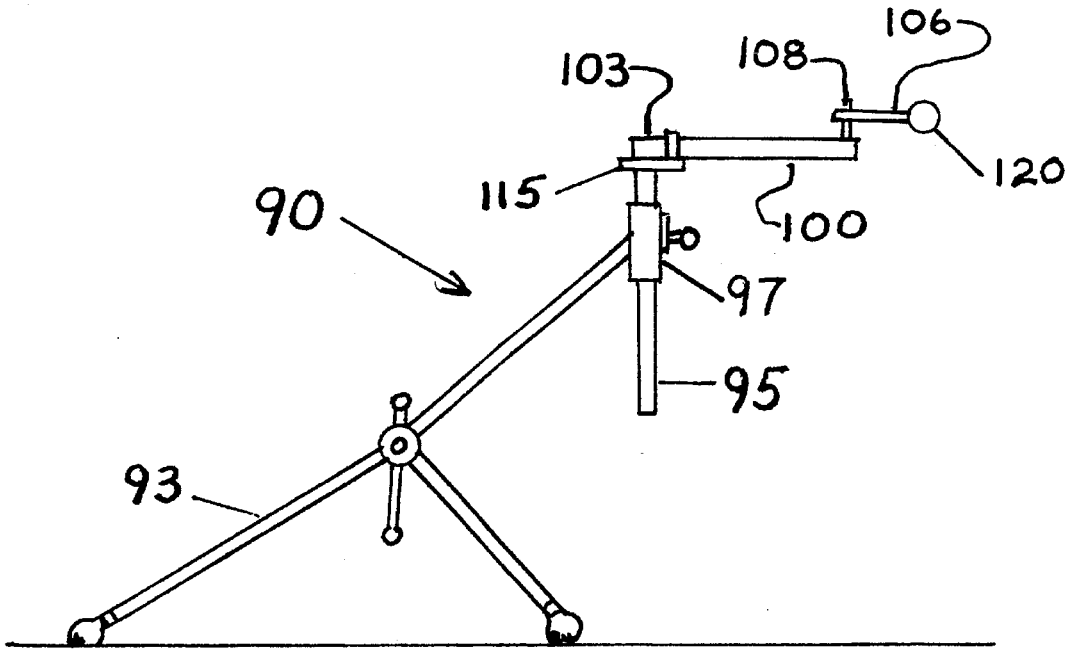
FIG. 6 depicts a hip turn guide according to the present invention.
Figure 7A:
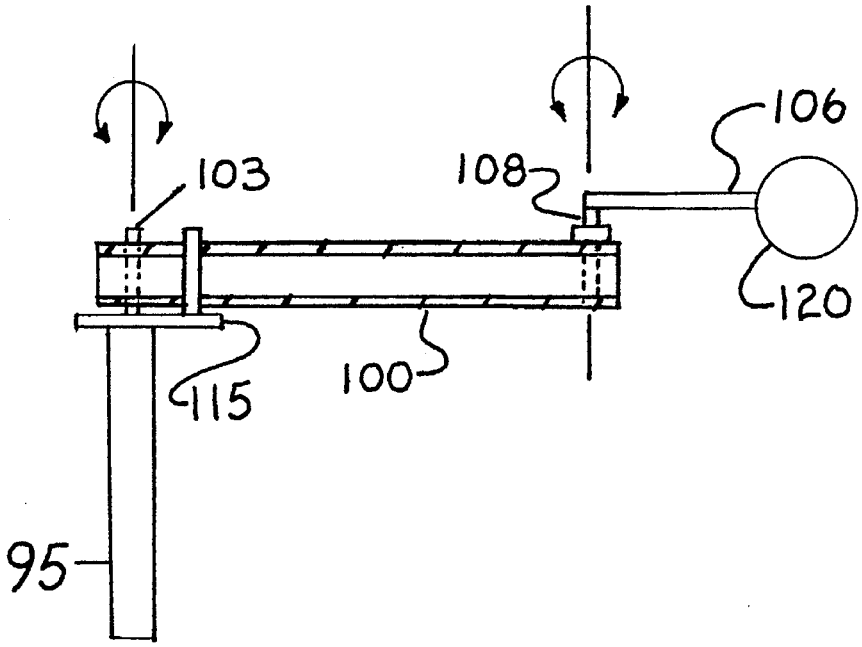
FIGS. 7A and 7B provide detail views of the hip turn guide of FIG. 6.
Figure 7B:
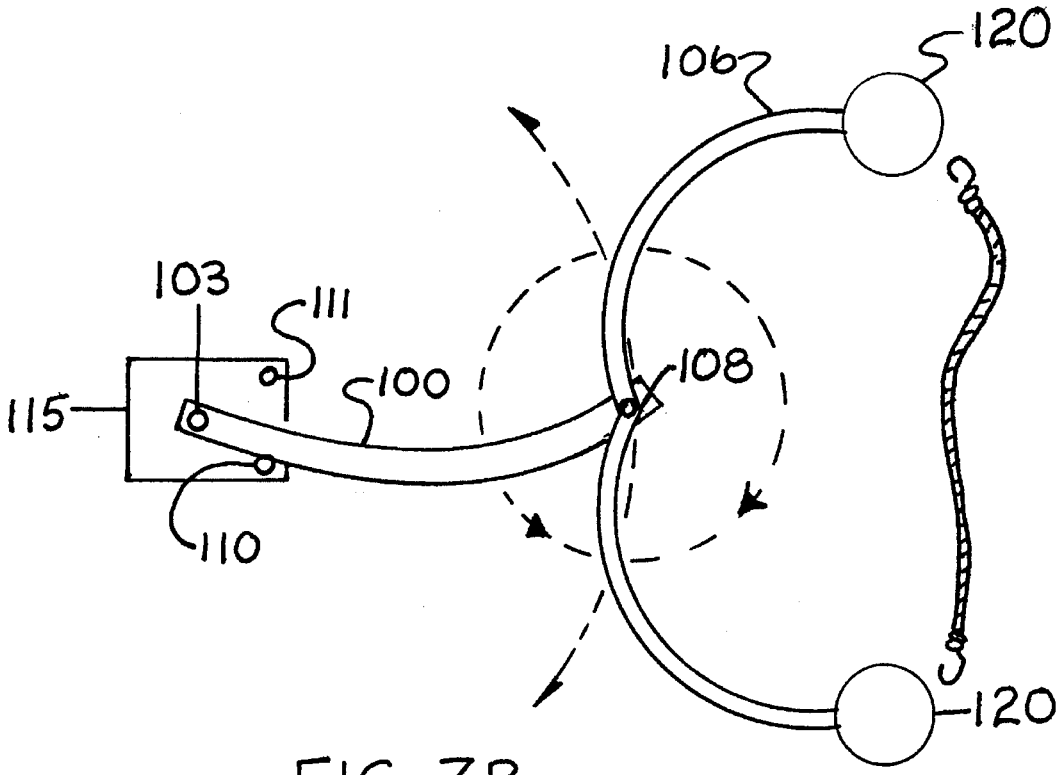

The second of the five elements of the complete system is a hip turn guide. This element assists the golfer in developing the proper motion in his legs and hips through the back swing, down swing, and follow-through of the stroke. The hip turn guide is depicted in FIGS. 6, 7A, and 7B. Hip turn guide 90 may be supported by a pedestal 93 by sliding vertical support 95 into mast channel 97 on the pedestal. Conveniently, the pedestal may be identical to the one used to support the hand swing plane guide described above. Thus, a single pedestal may be used alternatively with either of these two elements. Of course, if it is desired to use the hip turn guide simultaneously with the hand swing plane guide, then two separate pedestals will be necessary.

FIGS. 7A and 7B depict side and top views of the hip turn guide. As depicted therein, hip turn guide 90 includes a vertical support 95, a curved pivot arm 100 pivoting about a first pivot 103 on the vertical support, and a guiding arm 106 pivoting about a second pivot 108 on the pivot arm. Pivotal motion of the guiding arm is unrestrained; the guiding arm may turn through a full circle about second pivot 108. Pivotal motion of the pivot arm is limited by a pair of stops 110 and 111 secured to a bearing plate 115 upon which the pivot arm is supported. Stops 110 and 111 limit pivotal motion of the pivot arm to a limited arc about first pivot 103.

In an exemplary embodiment, the relevant dimensions of the various parts of hip turn guide 90 are as follows. Pivot arm 100 starts as a straight bar eleven inches long. Six and one-half inches at one end are left straight; the remaining five and one-half inches of the bar are bent to a curve having a radius of four and one-half inches. Guiding arm 106 starts as a straight bar twenty-three inches long. The guiding arm is then bent to include a pair of curves each having a radius of four and one half inches. Stops 110 and 111 are set with respect to first pivot 103 so that the pivot arm is limited to motion through an arc of approximately two and one-half inches at the position of second pivot 108.

To use the hip turn guide, the user first adjusts the height of pedestal 93 and the height of vertical support 95 with respect to the pedestal so that guiding arm 106 is held approximately two inches above the golfer's knees in the address position. The golfer backs up to rest his legs lightly against the guiding arm. The golfer then secures an elastic strap 118 (e.g., a "bungee" cord) across the front of his legs to secure the guiding arm against the backs of his legs. Elastic strap 118 is held on guiding arm 106 by a pair of spherical members 120 fixed on the end of the guiding arm. In addition to retaining the elastic strap, the spherical members protect the golfer's legs from injury from contact with the ends of the guiding arm.

The golfer begins his swing in the address position with his feet positioned so that pivot arm 100 is approximately centered between stops 110 and 111. In this position, stops 110 and 111 are aligned with the intended swing path as are the golfer's feet. The swing begins with the back swing. During the back swing, pivot arm 100 pivots about first pivot 103 until pivot arm 100 contacts back stop 110. Simultaneously, guiding arm 106 pivots clockwise approximately forty-five degrees about second pivot 108 on pivot arm 100.

The golfer then begins the down swing and the follow-through. Pivot arm 100 moves forward against front stop 111 and guiding arm 106 pivots counterclockwise approximately 135 degrees from the back swing position. The curvature in pivot arm 100 allows the golfer to move his legs and hips through the desired rotation. By repeated practice with the hip turn guide, progressing gradually from slow speed to full speed swings, the golfer can develop a feel for the proper motion of the hips and legs during the swing.

C. The Take-Away Guide

Figure 8:
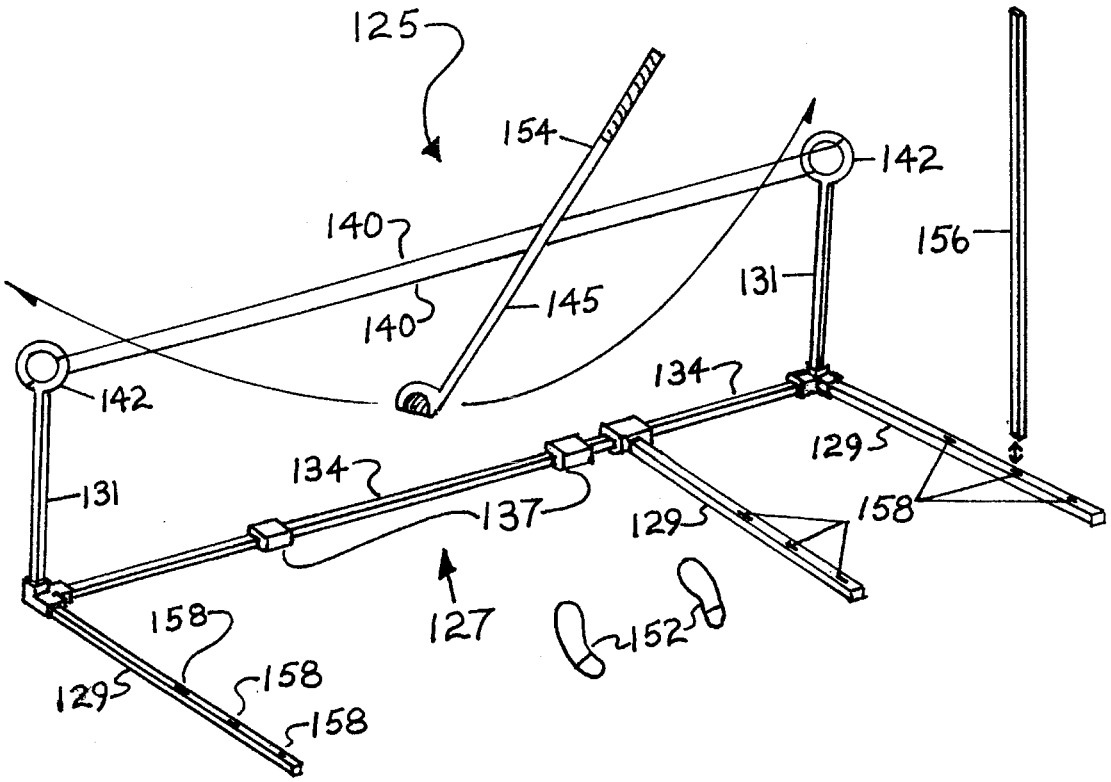
FIG. 8 shows a take-away guide according to the present invention.

The third of the five elements is a take-away guide. This element is intended to assist the golfer in achieving a correct and constant angle of attack of the club shaft with respect to the ground during the lower portions of the backswing, downswing and follow-through. The take-away guide is illustrated in FIG. 8. As depicted therein, take-away guide 125 comprises a base 127 including a number of legs 129, and a pair of uprights 131. In the embodiment depicted, base 127 is assembled from a number of sections 134, which fit together by means of connections 137 between individual sections. Additionally, legs 129 and uprights 131 are removably fitted into the base. The take away guide is therefore easily disassembled and assembled for transportation and use.

A pair of strings 140 run between uprights 131, which in the preferred embodiment are held some nine feet apart. Elasticity in the strings helps to hold the base sections together. Strings 140 run parallel between a pair of rings 142 at the top of the uprights. The two parallel strings define a plane whose slope corresponds to the proper angle of golf club shaft 145 with respect to the ground.

Figure 9:
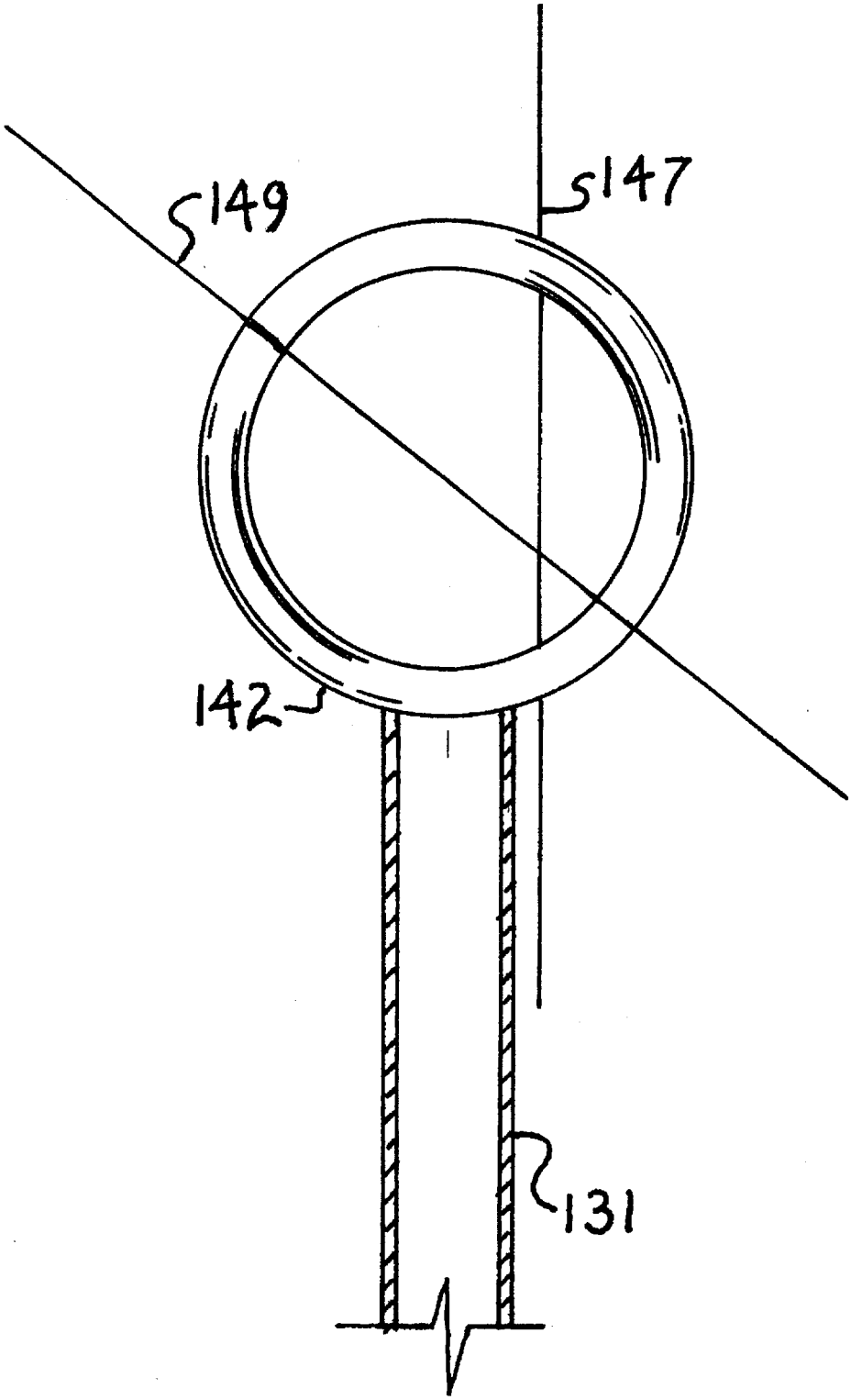
FIG. 9 depicts a ring at the top of an upright that forms a part of the take-away guide of FIG. 8.

The proper club shaft angle will vary depending on the club. For putters, the shaft will be near vertical; other clubs will have preferred angles that are quite different. Two exemplary planes 147 and 149 defined by strings 140 are depicted in FIG. 9. As shown therein, the slope of the defined plane can be conveniently adjusted by moving the ends of the strings around the circumference of rings 142.

To use the take-away guide the golfer stands at a position indicated symbolically by footprints 152 in FIG. 8. The golfer then takes up club 154, and adjusts strings 140 on rings 142 so that the plane defined by the strings corresponds to the slope of the club shaft. Starting slowly, the golfer begins a series of practice swings. The golfer's aim is to maintain the club in a plane in which the shaft just touches both of the strings simultaneously, without bearing heavily on either of them, throughout the lower part of the swing. As the golfer develops proficiency, he may increase the speed of his practice swings from very slow up to full speed using the pair of strings as a guide to indicate the proper angle of the club shaft.

Optionally, a set of dowels 156, one of which is depicted in FIG. 8, may be inserted into holes 158 in the legs 129 of base 127. Dowels may be inserted into none, some, or all of the holes as desired. When used, the dowels serve as visual frames of reference indicating fixed points in space. Some golfers will find these fixed points useful for developing and repeating the desired strokes. If the dowels are used they should not be so tall as to interfere with the swing of the club. In any event, the dowels should desirably fit into the hole somewhat loosely so that they will pop loose in case of inadvertent contact between the club shaft and the dowel.

D. The Plumb Bob Guide

Figure 10:
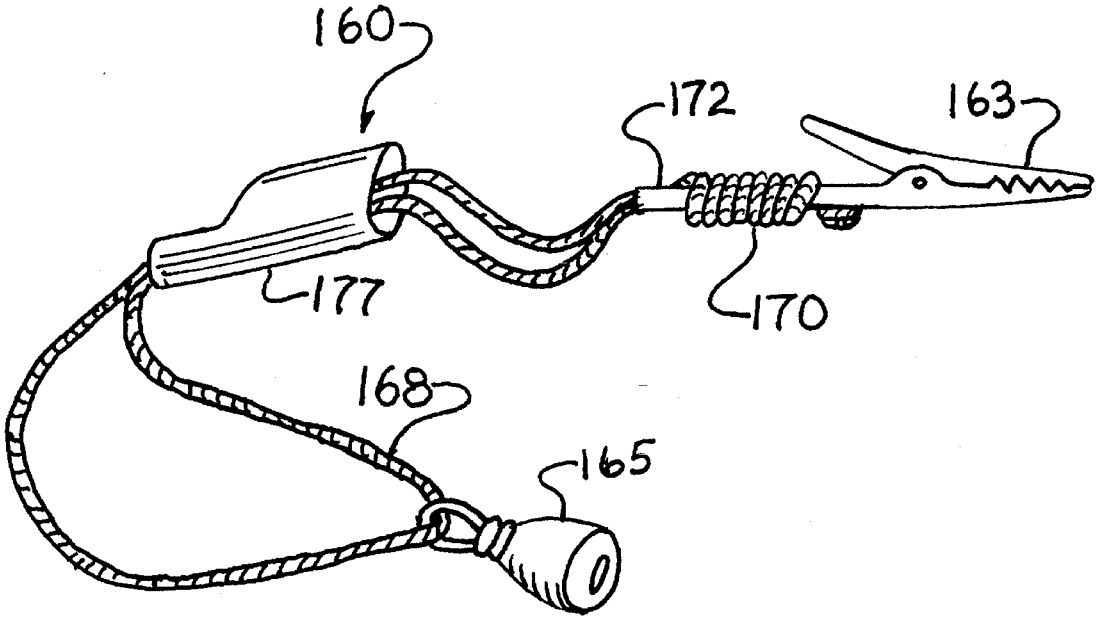
FIG. 10 shows a plumb bob guide according to the present invention.

The fourth element of the system is a plumb bob guide, an embodiment of which is depicted in FIG. 10. During putting and other "pendulum" type swings, it is desirable that the golfer keep his head steady with his eyes over the ball and aligned with the desired path of the struck ball. The plumb bob guide assists the practicing golfer in achieving these objectives.

As depicted in FIG. 10, plumb bob guide 160 comprises an alligator clip 163 with a small (approximately two ounces) weight 165 attached to it by a looped length of cord 168. The effective length of cord 168 can be adjusted by wrapping excess cord 170 around shaft 172 at one end of alligator clip 163. Excess cord 170 may be conveniently secured by means of a pliable rubber boot 177, which can be slipped onto shaft 172 over the wrapped portion of the cord.

Figure 11:
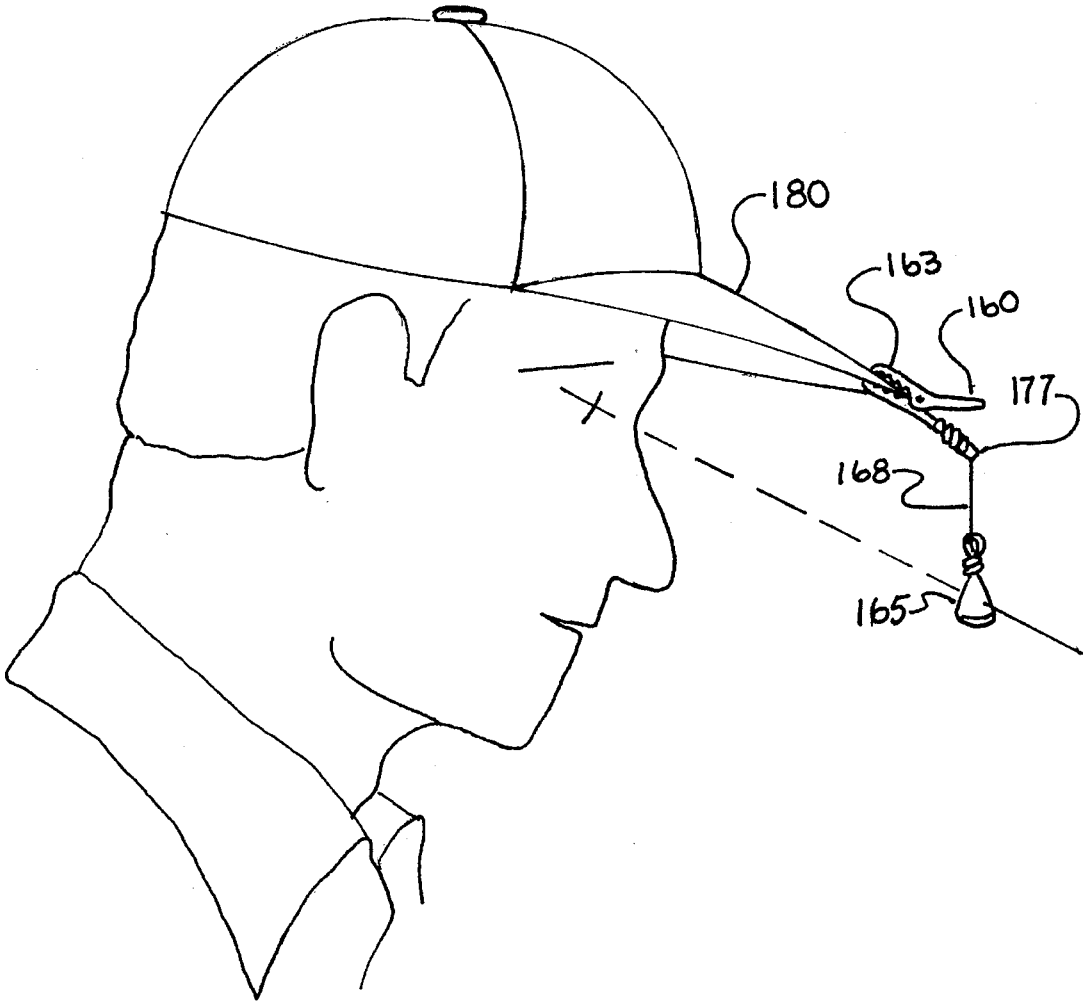
FIG. 11 depicts the plumb bob guide of FIG. 10 in use.

The plumb bob guide may be used as depicted in FIG. 11. The golfer frees a short (approximately 2 inches) length of cord 168 from alligator clip 163 and secures the remainder under boot 177. The golfer then clips the device to the bill 180 of his cap with weight 165 hanging down where he can see it. The golfer may then practice pendulum type strokes with the putter or another club. Any undesired bobbing, turning or other motion of the golfer's head will be clearly and immediately indicated to the golfer by bouncing or swinging of weight 165 at the end of cord 168. The golfer continues his practice swings until the motion of weight 165 is substantially eliminated.

Figure 12A:
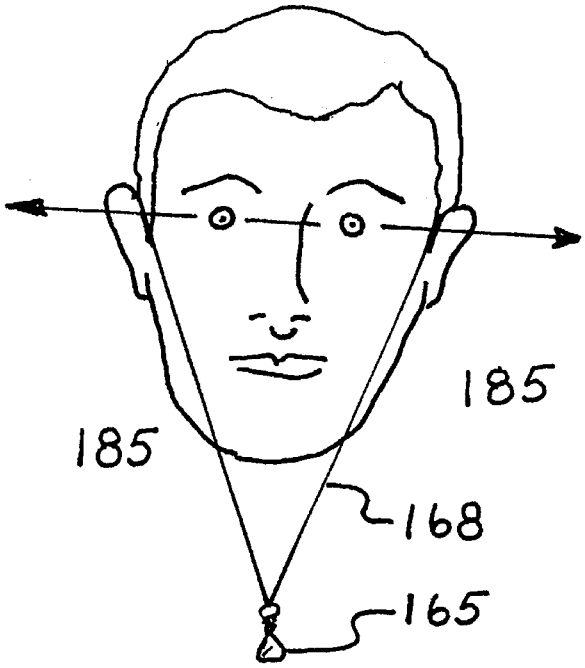
FIGS. 12A and 12B show an alternate use of the plumb bob guide of FIG. 10.
Figure 12B:
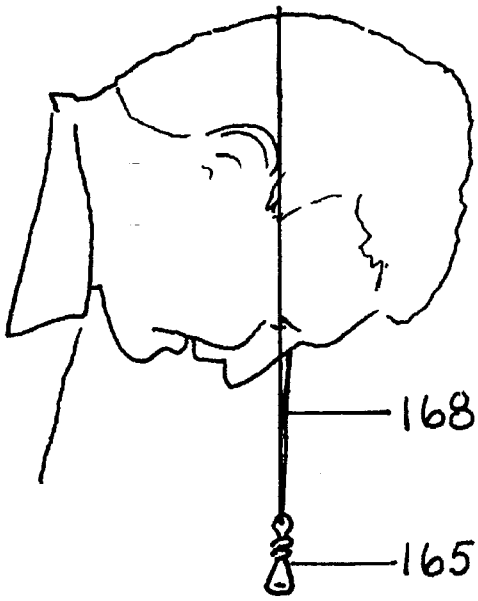

The golfer may also use the plumb bob device as depicted in FIGS. 12A and 12B. To do so, the golfer frees a longer length (about sixteen inches) of cord 168 from the shaft of alligator clip 163. The golfer then drapes this loop of cord over his head just above his ears. When properly positioned, weight 165 will line up over golf ball 183 when the golfer is in the address position, as depicted in FIG. 12B. This assists the golfer in assuming the proper stance with his eyes over the ball. Furthermore, as depicted in FIG. 12A, the golfer may use the two sides 185 of cord 168, which he will be able to see out of the corners of his eyes, to align his stance so that his eyes lie along the desired path of the struck ball. The two sides of the cord define a plane, when this plane is aligned with the desired path of the ball, the golfer's eyes will be properly aligned as well. Finally, any undesired motion of the golfer's head will be clearly indicated by motion of weight 165 as described above.

Figure 13:
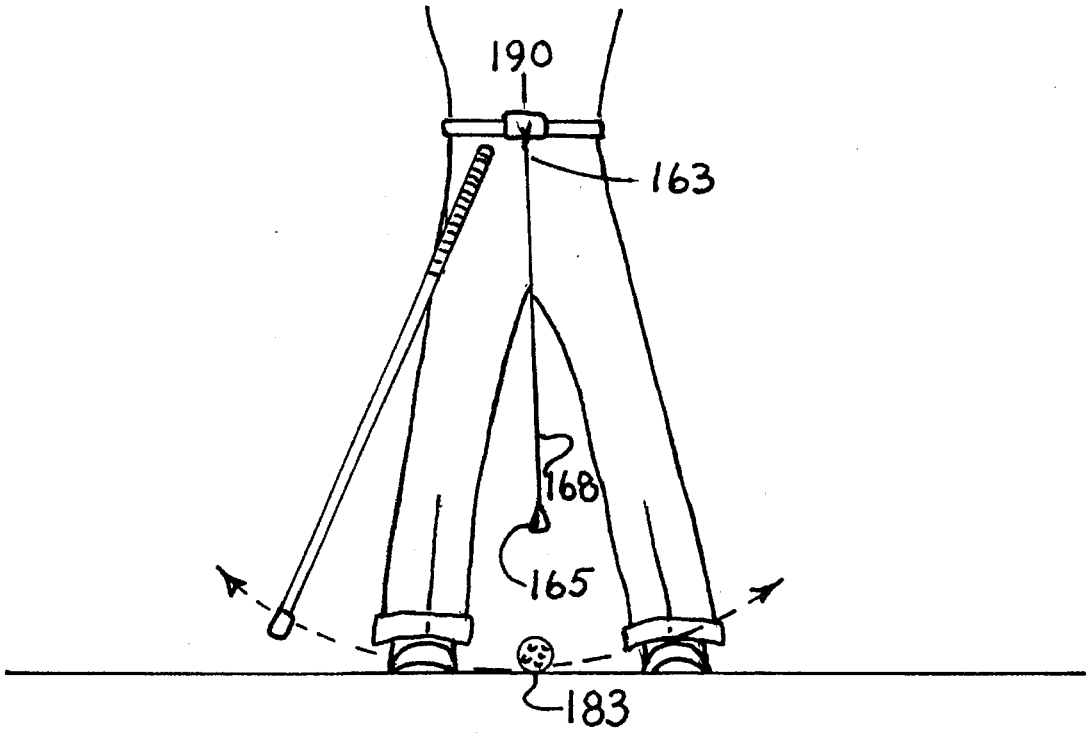
FIG. 13 depicts still another use of the plumb bob guide of FIG. 10.

A further use of the plumb bob guide is depicted in FIG. 13. To use plumb bob guide 160 in this manner, the golfer clips alligator clip 163 Onto his belt buckle 190 or otherwise on his waist band. When the golfer is properly positioned, weight 165 will be centered between the golfer's feet. As the golfer executes a pendulum swing, his hips should remain stationary. Once again, undesired motion will be indicated by motion of the plumb bob guide.

E. The Wrist Guide

Figure 14:
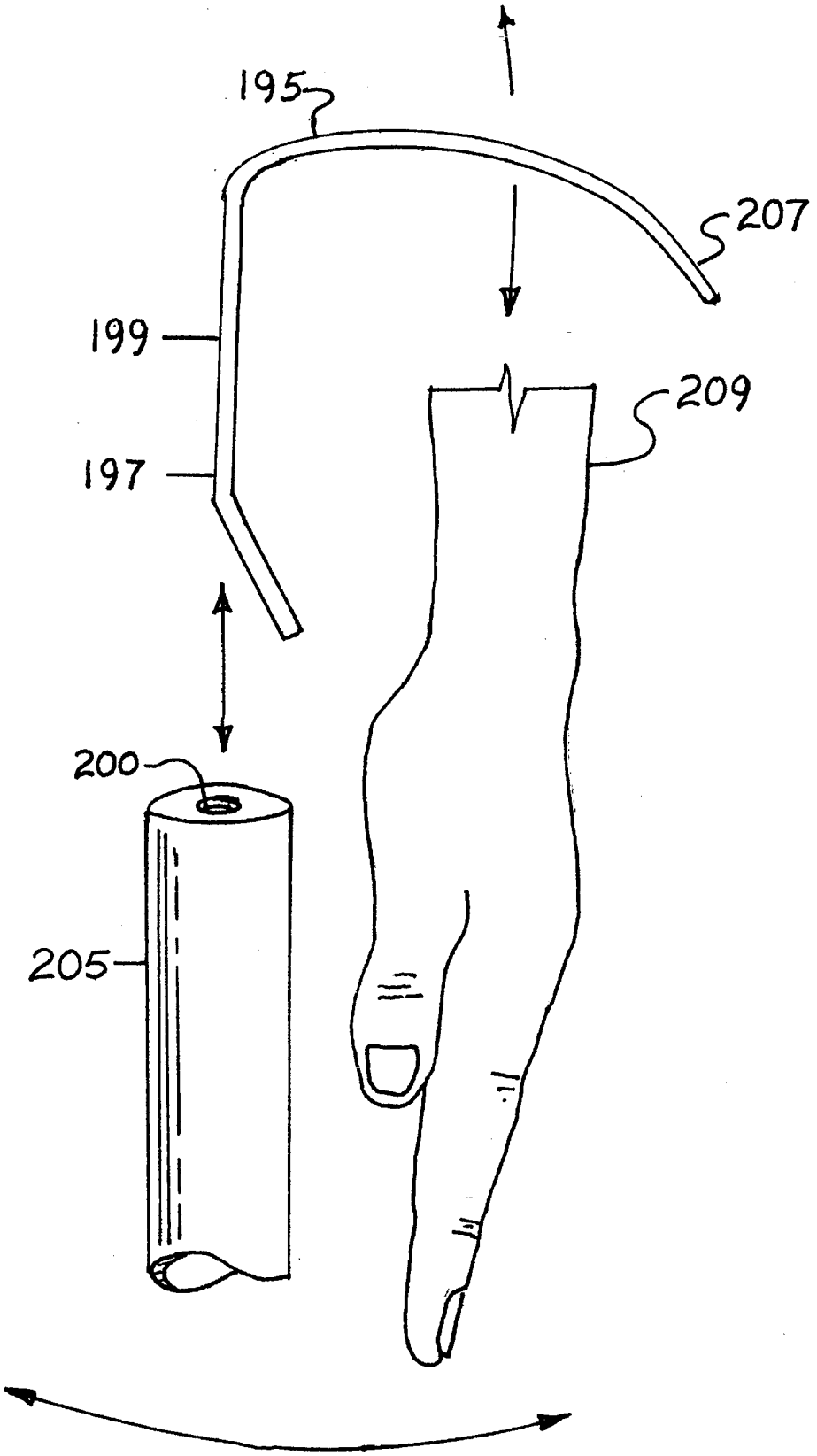
FIG. 14 provides a view of a wrist guide according to the present invention.

The final element of the five element system is a wrist guide. Wrist guide 195, in an exemplary embodiment, comprises a loop of wire bent substantially as shown in FIG. 14. One end 197 of wire loop 199 is inserted into a hole 200 in handle 205 of the golfer's putter or another club to be used with a pendulum type swing. The other end 207 is bent around so that it bears lightly against the golfer's wrist 209. During a proper pendulum swing, the golfer should not allow rotational motion, or "hinging" in his wrists. If the golfer's wrists do hinge during the swing, this undesired motion will be clearly communicated to the golfer by motion of wire loop 199 brushing up and down against his wrist.

CONCLUSION

The system described above will greatly assist a developing golfer in learning a proper golf swing. Specific embodiments have been described in detail for clarity and ease of understanding. However, significant departures from the described embodiments may be made without departing from the teachings of the invention. Therefore, the scope of the invention should be determined with reference to the appended claims, along with the full scope of equivalents to which those claims are entitled.

What is claimed is:

1. A golf swing trainer usable by a golfer with a golf club having a shaft, the swing trainer comprising:

a rotor support;

a rotor rotatably mounted to the rotor support, said rotor rotatable about a rotational axis; and means for connecting the rotor to at least one of the group consisting of the golfer's hands, the golfer's arms near his hands, and the golf club shaft;

wherein the rotor is comprised of a flexible material and wherein flexure of the rotor occurs in response to deviations in the golfer's swing from a circular path centered around the rotor's rotational axis.

2. The swing trainer of claim 1, wherein the rotor support comprises a pedestal including a plurality of legs, a mast support extending from said pedestal, and a mast attached to the mast support.

3. The swing trainer of claim 2, wherein the angle of the mast is adjustable by rotation of the mast support with respect to the pedestal.

4. The swing trainer of claim 2, wherein the height of the mast is adjustable by extending the mast with respect to the mast support.

5. The swing trainer of claim 2, wherein the legs of the base are individually adjustable to accommodate sloping surfaces under the base.

6. The swing trainer of claim 5, wherein the legs are adjustable by rotation about a common axis passing through the base.

7. The swing trainer of claim 1, further comprising an inclinometer mounted on the rotor support to indicate the angle of the rotational axis.

8. The swing trainer of claim 1, wherein the rotor has a rotational inertia about its rotational axis that is less than the rotational inertia of the golf club about the rotational axis of the rotor.

9. The swing trainer of claim 8, wherein the rotor has a rotational inertia about its rotational axis that is less than one-third of the rotational inertia of the golf club about the rotational axis of the rotor.

10. The swing trainer of claim 9, wherein the rotor has a rotational inertia about its rotational axis that is less than fifteen percent of the rotational inertia of the golf club about the rotational axis of the rotor.

11. The swing trainer of claim 1, wherein the rotor is comprised of a material selected from the group consisting of wood, fiberglass, aluminum, and filament wound epoxy and wherein the rotor has a diameter of less than one-half inch.

12. The swing trainer of claim 1, further comprising an extension arm attachable to the rotor near one end of the rotor.

13. A golf swing trainer usable by a golfer with a golf club having a shaft, the swing trainer comprising:

a rotor support;

a rotor rotatably mounted to the rotor support, said rotor rotatable about a rotational axis; and means for connecting the rotor to at least one of the group consisting of the golfer's hands, the golfer's arms near his hands, and the golf club shaft;

wherein the rotor has a rotational inertia about its rotational axis that is substantially less than the rotational inertia of the golf club about the rotational axis of the rotor.

14. The swing trainer of claim 13, wherein the rotor support comprises a pedestal including a plurality of legs, a mast support extending from said pedestal, and a mast attached to the mast support.

15. The swing trainer of claim 14, wherein the angle of the mast is adjustable by rotation of the mast support with respect to the pedestal.

16. The swing trainer of claim 14, wherein the height of the mast is adjustable by extending the mast with respect to the mast support.

17. The swing trainer of claim 14, wherein the legs of the base are individually adjustable to accommodate sloping surfaces under the base.

18. The swing trainer of claim 17, wherein the legs are adjustable by rotation about a common axis passing through the base.

19. The swing trainer of claim 13, further comprising an inclinometer mounted on the rotor support to indicate the angle of the rotational axis.

20. The swing trainer of claim 13, wherein the rotor has a rotational inertia about its rotational axis that is less than one-third of the rotational inertia of the golf club about the rotational axis of the rotor.

21. The swing trainer of claim 20, wherein the rotor has a rotational inertia about its rotational axis that is less than fifteen percent of the rotational inertia of the golf club about the rotational axis of the rotor.

22. The swing trainer of claim 13, wherein the rotor is comprised of a flexible material and wherein flexure of the rotor occurs in response to deviations in the golfer's swing from a circular path centered around the rotor's rotational axis.

23. The swing trainer of claim 13, wherein the rotor is comprised of a material selected from the group consisting of wood, fiberglass, aluminum, and filament wound epoxy and wherein the rotor has a diameter of less than one-half inch.

24. The swing trainer of claim 13, further comprising an extension arm attachable to the rotor near one end of the rotor.

* * * * *